US007162823B2

(12) United States Patent
Schoppman et al.

(10) Patent No.: US 7,162,823 B2
(45) Date of Patent: Jan. 16, 2007

(54) FIREARM STOCK CONNECTOR

(75) Inventors: Edward D. Schoppman, Greensboro, NC (US); Randall S. Murphy, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 11/066,021

(22) Filed: Feb. 25, 2005

(65) Prior Publication Data

US 2005/0215092 A1 Sep. 29, 2005

Related U.S. Application Data

(60) Provisional application No. 60/547,913, filed on Feb. 26, 2004.

(51) Int. Cl.
*F41A 21/00* (2006.01)

(52) U.S. Cl. ..... 42/75.01; 42/75.03

(58) Field of Classification Search ..... 42/75.01, 42/75.03

See application file for complete search history.

(56) References Cited

U.S. PATENT DOCUMENTS

| | | | | |
|---|---|---|---|---|
| 487,466 | A | 12/1892 | Bennett | |
| 487,486 | A | 12/1892 | Mason | |
| 1,071,173 | A * | 8/1913 | Pedersen | 42/75.01 |
| 1,331,074 | A | 2/1920 | Marble | |
| 1,331,075 | A | 2/1920 | Marble | |
| 2,247,011 | A * | 6/1941 | Browning | 42/18 |
| 2,302,059 | A | 11/1942 | Roemer | |
| 2,336,431 | A * | 12/1943 | Williams | 42/75.01 |
| 3,009,227 | A | 11/1961 | Ryan | |
| 4,601,123 | A | 7/1986 | Swearengen et al. | |
| 5,173,564 | A | 12/1992 | Hammond, Jr. | |
| 6,250,194 | B1 | 6/2001 | Brandl et al. | |
| 6,374,528 | B1 | 4/2002 | Davis et al. | |
| 6,427,372 | B1 | 8/2002 | Howard et al. | |
| 6,651,371 | B1 | 11/2003 | Fitzpatrick et al. | |
| 6,662,485 | B1 | 12/2003 | Kay | |
| 2003/0029070 | A1 | 2/2003 | Dowding | |
| 2004/0211104 | A1 | 10/2004 | Eberle | |

FOREIGN PATENT DOCUMENTS

| | | |
|---|---|---|
| BE | 388 448 | 6/1932 |

OTHER PUBLICATIONS

Modern Firearms—FN MAG / M240 Machinegun, Modern Firearms Machine Guns (http://world.guns.ru/machine/mg06-e.htm).

* cited by examiner

*Primary Examiner*—Michael J. Carone
*Assistant Examiner*—Benjamin P. Lee
(74) *Attorney, Agent, or Firm*—Womble Carlyle Sandridge & Rice PLLC

(57) ABSTRACT

A stock connector allows for secure attachment of various stocks to firearm receivers. The stocks can be changed out easily and quickly in the field, without the use of specialized tools.

24 Claims, 17 Drawing Sheets

FIREARM STOCK CONNECTOR

CROSS-REFERENCE TO RELATED APPLICATIONS

This application claims the benefit of U.S. Provisional Application No. 60/547,913, filed Feb. 26, 2004, which is hereby incorporated by reference in its entirety.

TECHNICAL FIELD

The present invention generally relates to firearms, and in particular to a connector system for enabling easy and rapid removal and change out of the stock configuration for firearms.

BACKGROUND

Firearms, and primarily rifles, shotguns and other long guns, are increasingly being produced with a variety of different stock configurations or designs, ranging from traditional full length shoulder stocks to pistol grips and to folding stocks and other designs. There has also been an increasing demand for aftermarket gunstocks that allow owners to customize firearms for more comfortable fit and feel, and/or to adapt firearms to varying mission requirements. Recently, firearms have made use of a sliding joint, such as a "T-slot," and locking screws to facilitate attachment and removal of the gunstock. For example, the FN-M240 machine gun includes a slotted connection arrangement.

Most rifle and shotgun stocks, however, generally are not designed to be readily removable, and are instead secured in place with screws, bolts, etc. that require specialty tools for removal. Existing arrangements also require significant time and effort to remove or change out the stock, and change out often must be done by a trained gunsmith. Such limitations discourage removal, replacement, and change out of conventional stock configurations, especially while in the field.

Accordingly, it can be seen that a need exists for a firearm stock connector that facilitates the efficient, rapid and secure change out of a firearm stock without requiring specialized tools and/or training.

SUMMARY

According to a first aspect, a firearm comprises barrel having an axis, a receiver, a stock, a first connector connected to the receiver, a second connector connected to the stock, and a locking member extending generally transverse to a long axis of the firearm, wherein the first and second connectors connect the receiver to the stock by a dovetail locking arrangement, and the locking member secures the first connector relative to the second connector.

According to a second aspect, a method of assembling a firearm comprises attaching a first connector to a receiver, attaching a second connector to a stock, slidably engaging the first connector with the second connector along a first direction, and securing the first connector relative to the second connector by engaging a locking member with the first and second connectors by inserting the locking member along a second direction, the second direction being generally transverse to the first direction.

According to a third aspect, a stock connector for connecting a receiver of a firearm to a firearm stock comprises a first connector having an engagement lug, the engagement lug having a recess, a second connector having a dovetail recess adapted to receive the engagement lug and a generally transverse receiving aperture, and a locking member adapted to be received in the receiving aperture and to enter the recess in the first connector when the engagement lug is mounted in the dovetail recess.

According to a fourth aspect, a stock connector comprises a first connector adapted to be connected to a first part of a firearm, a second connector adapted to be connected to a second part of a firearm, wherein the first connector comprises a generally transverse receiving aperture extending through the second connector and is slidably engageable with the first connector, a locking member adapted to be received in the receiving aperture and to secure the first connector to the second connector when the first and second connectors are slidably engaged.

According to a fifth aspect, a kit for changing out stocks for a firearm comprises a first connector, a first stock, a second stock of different configuration than the first stock, a second connector adapted to connect to the first stock, another second connector adapted to connect to the second stock, and a locking member, wherein the first connector is slidably engageable with both second connectors, and the locking member is engageable with the first connector and both second connectors.

According to the above aspects, stocks for firearms can be easily removed and replaced with alternate stocks, or simply removed to clean or otherwise maintain the firearm. The stock connector can be constructed so as to require no special tools or specialized skills to remove the stock. The first and second connectors and the locking member can be produced within specified tolerances to ensure tight connection between the receiver and stock.

BRIEF DESCRIPTION OF THE DRAWING FIGURES

DETAILED DESCRIPTION

Figure 1:
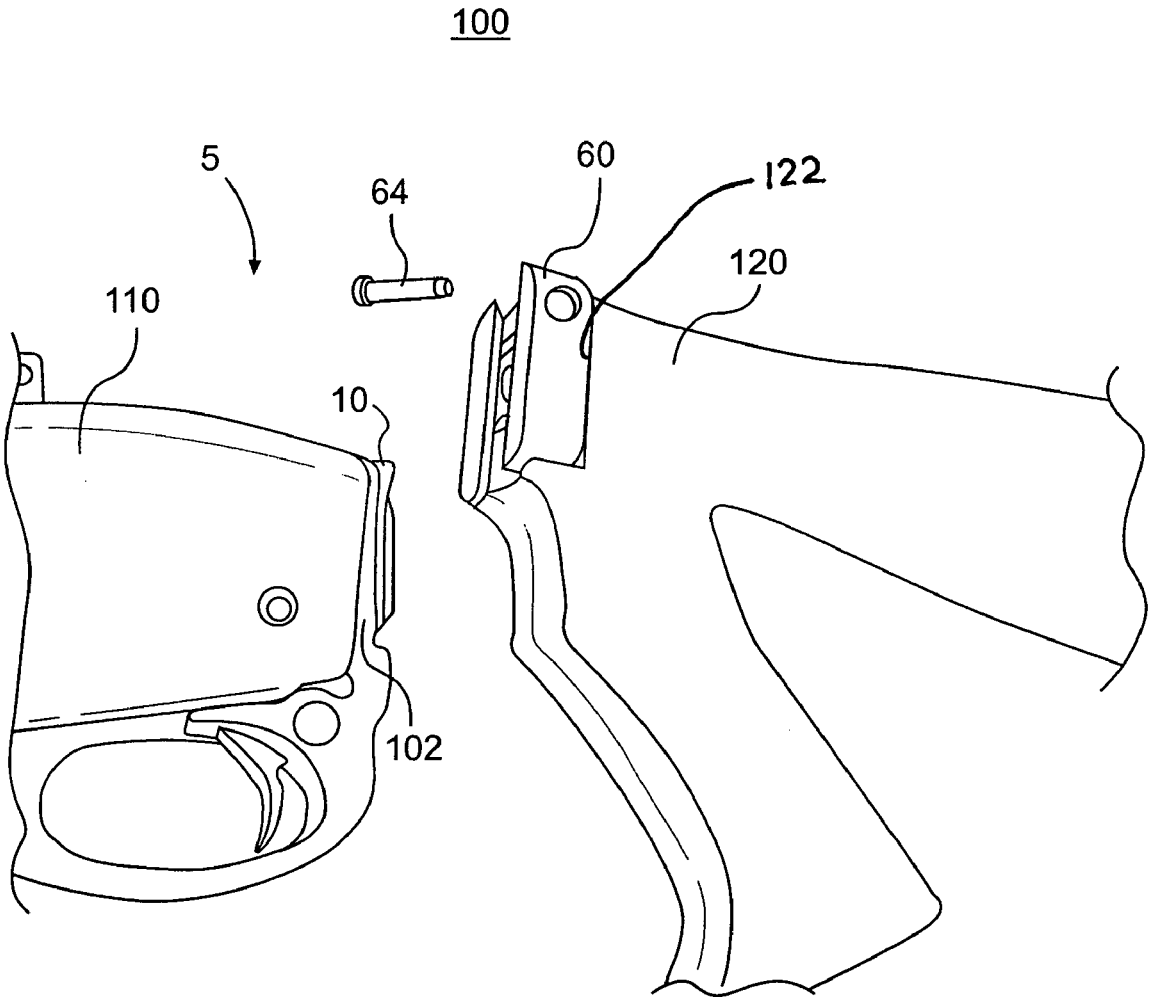
FIG. 1 is a perspective view of a partially disassembled firearm including a stock connector according to a first embodiment.

FIG. 1 illustrates a partially disassembled firearm 100 including a receiver 110 and a stock 120. A stock connector 5 according to the present embodiment is the mechanism by which the receiver 110 and the stock 120 are connected. The firearm 100 may be, for example, a shotgun, rifle or other long gun. The stock connector 5 generally includes a first or front connector 10 that is adapted to be attached to a rear end 102 of the receiver 110, and a second or rear connector 60 that is adapted to be attached to a front end 122 of the stock 120. A locking mechanism, shown in FIG. 1 as locking member 64, secures the first connector 10 to the second connector 60.

Figure 2:
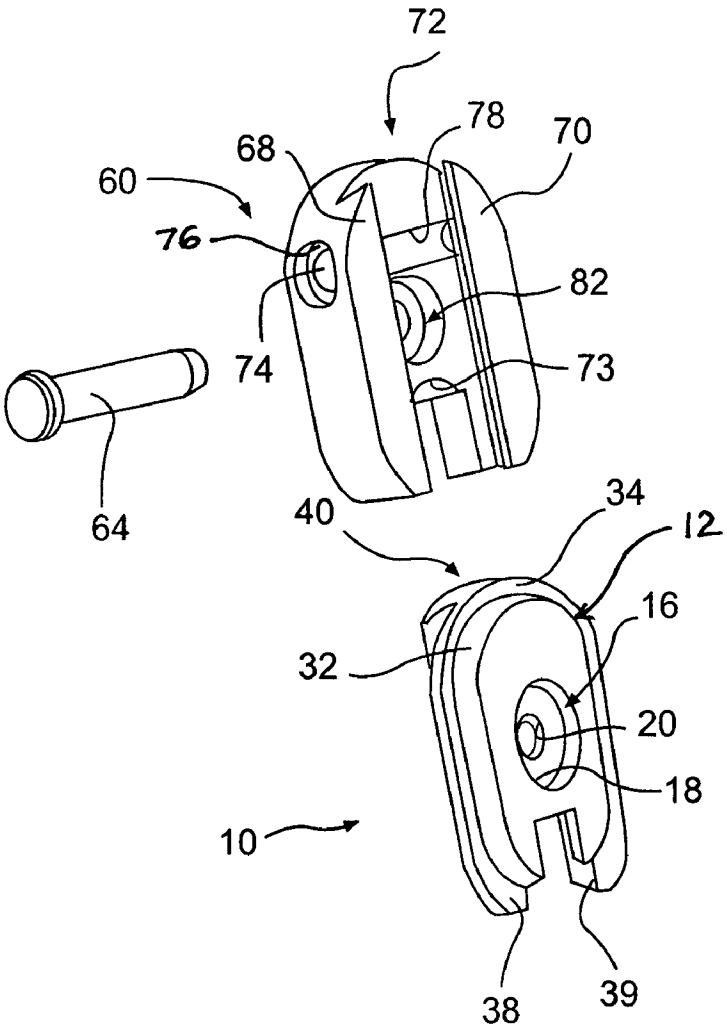
FIG. 2 is an exploded perspective view of the stock connector according to the first embodiment.
Figure 3:
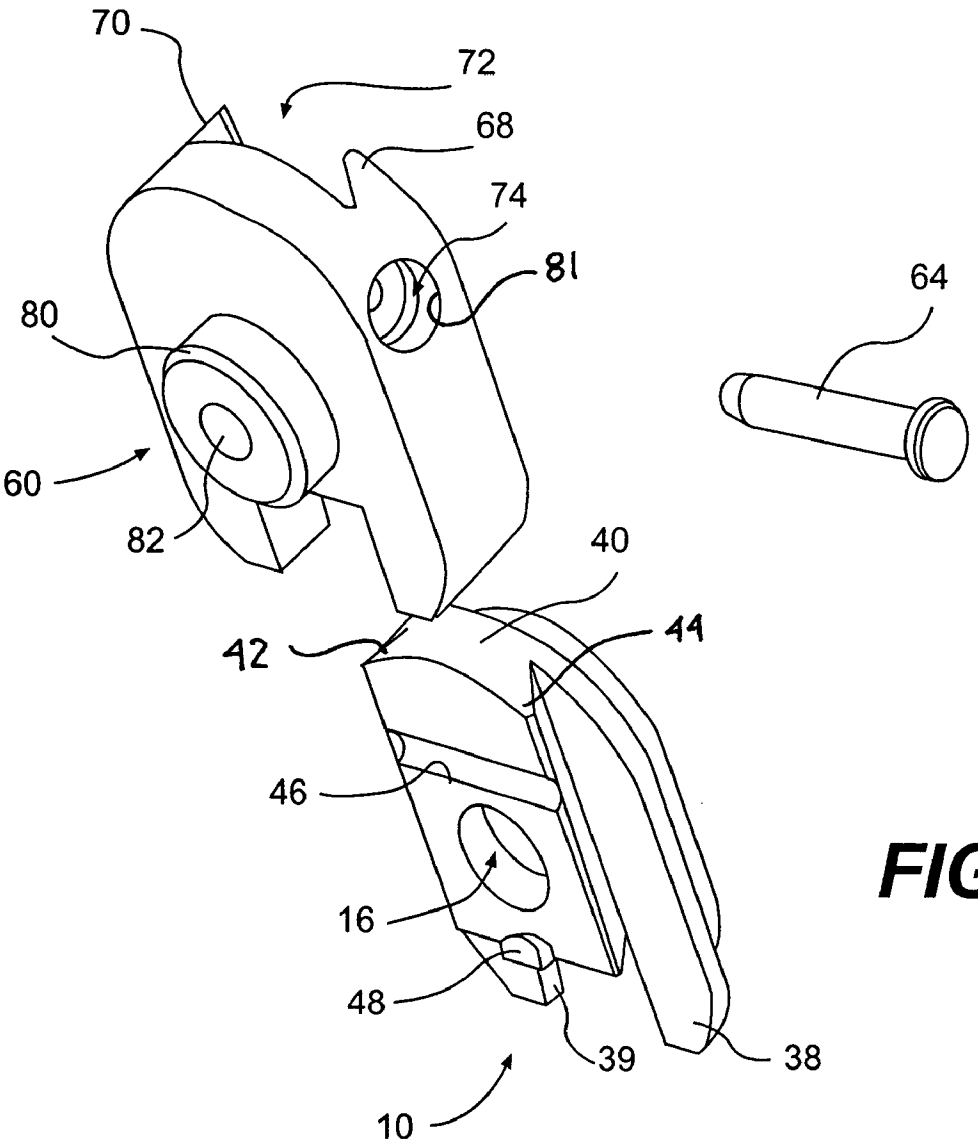
FIG. 3 is an exploded perspective view of the stock connector according to the first embodiment.

FIG. 2 is a perspective view illustrating the elements of the stock connector 5 in detail. FIG. 3 is a rear perspective view of the stock connector 5. As shown in FIGS. 2 and 3, the first connector 10 includes an engagement lug 40 that is adapted to slidably engage and lock with projections or arms 68, 70 of the second connector 60. The arms 68, 70 and the engagement lug 40 form a dovetail locking arrangement in which the engagement lug 40 is slidably engageable with a dovetail recess 72 between the two arms 68, 70. The dovetail arrangement can have a fairly tight tolerance to ensure minimal movement between the stock 120 and the receiver 110 in the assembled firearm 100. An arched stop recess 73 extends across a bottom portion of the dovetail recess 72 and defines an uppermost point of travel for the engagement lug 40 as it slides within the dovetail recess 72.

The first connector 10 generally includes a front mounting portion 12 adapted to engage and seat against a rear surface of the receiver 110, as is illustrated in FIG. 1. A stepped aperture or bore 16 including a large diameter bore 18 and a small diameter bore 20 may extend through the first connector 10. The stepped bore 16 may be adapted to receive a fastener 22 (shown in FIG. 6), such as, for example, a screw, rivet or bolt, that extends through the bore 16 and into the receiver 110 in order to secure the first connector 10 to the receiver 110. The first connector 60 can also be attached to the receiver 110 by a variety of other mechanisms, such as, for example, a weld, adhesives such as epoxies or other, similar adhesive materials.

Referring to FIG. 2, the front mounting portion 12 includes a peripheral relief 32 that extends around the periphery of the first connector 10. The peripheral relief 32 allows a face 34 of the first connector 10 to rest against the rear surface of the receiver 110, while a projecting portion 36 extends into a cavity or recess of the receiver 110. The attachment of the first connector 10 to the receiver 110 is discussed in further detail below with reference to FIGS. 5–7. The first connector 10 also includes downward projections 39, 39 that may generally conform in external profile to the profile of the receiver 110.

Figure 4:
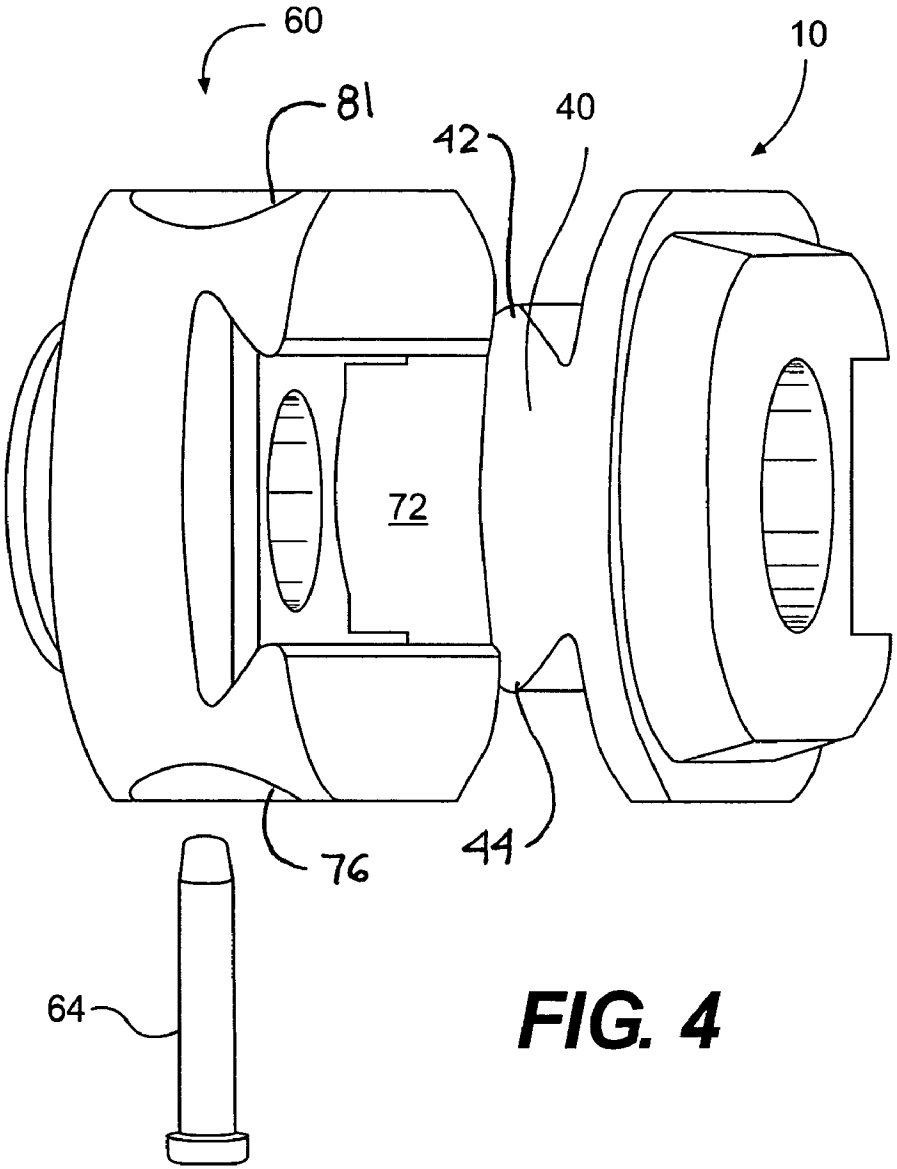
FIG. 4 is an exploded top perspective view of the stock connector according to the first embodiment.

As shown in FIGS. 3 and 4, the engagement lug 40 includes two projecting edges 42, 44 and a transversely extending locking slot or recess 46. The locking recess 46 may be arcuate in cross section which may be adapted to generally correspond to the periphery of the locking member 64. A transverse receiving aperture or bore 74 extends through the second connector 60 and is adapted to receive the locking member 64. The receiving aperture 74 comprises a first transverse bore 76 (shown in FIG. 2), a transverse slot or recess 78, and a second transverse bore 81. The first and second bores 76, 81 and the recess 78 can have circular or arcuate cross sections that may generally correspond to the periphery of the locking member 64, and may be formed in one or more drilling operations. When the engagement lug 40 is received within the dovetail recess 72 of the second connector 60, and the locking member 64 is received within the receiving aperture 74, the engagement of the locking member 64 with the locking recess 46 prevents axial translation and slidable removal of the engagement lug 40 from the arms 68, 70. The locking member 64 thereby fixes the position of the first connector 10 relative to the second connector 60.

The receiving aperture 74 is described herein as 'transverse' to indicate that the bores 76, 81 and the slot or recess 78 extend generally perpendicular or transverse to a long axis of the firearm 100. The long axis of the firearm 100 can correspond generally to the axis of the firearm barrel. The term 'transverse' does not require strict perpendicularity with the long axis of the firearm, however.

Referring to FIG. 3, the second connector 60 may also include a projecting stud or lug or post 80 that extends into and engages an interior portion of the stock 120. A stepped bore or aperture 82 may extend through the second connector 60 to receive a fastener such as a screw or bolt therein in order to secure the second connector 60 to the stock 120. The stud 80 can be machined integrally with the second connector 60, or it may be a removable piece attached to the connector 60 by a threaded arrangement or another attachment mechanisms. The second connector 60 can also be attached to the stock 120 by a variety of fasteners or other mechanisms, such as, for example, a weld, adhesives such as epoxies or other, similar adhesive materials.

Figure 5:
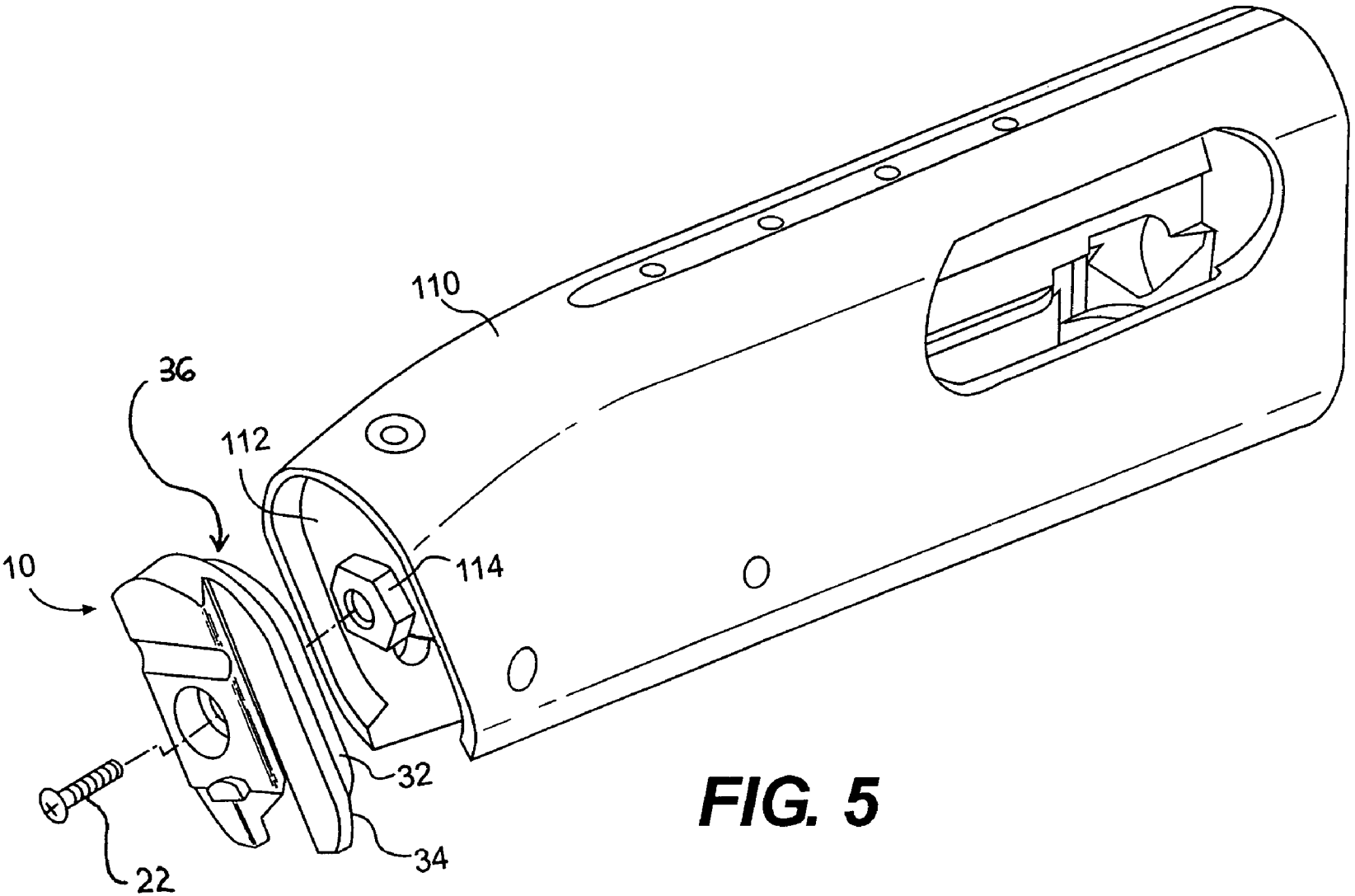
FIG. 5 is a perspective view of an assembly step for assembling a firearm using the stock connector according to the first embodiment.
Figure 6:
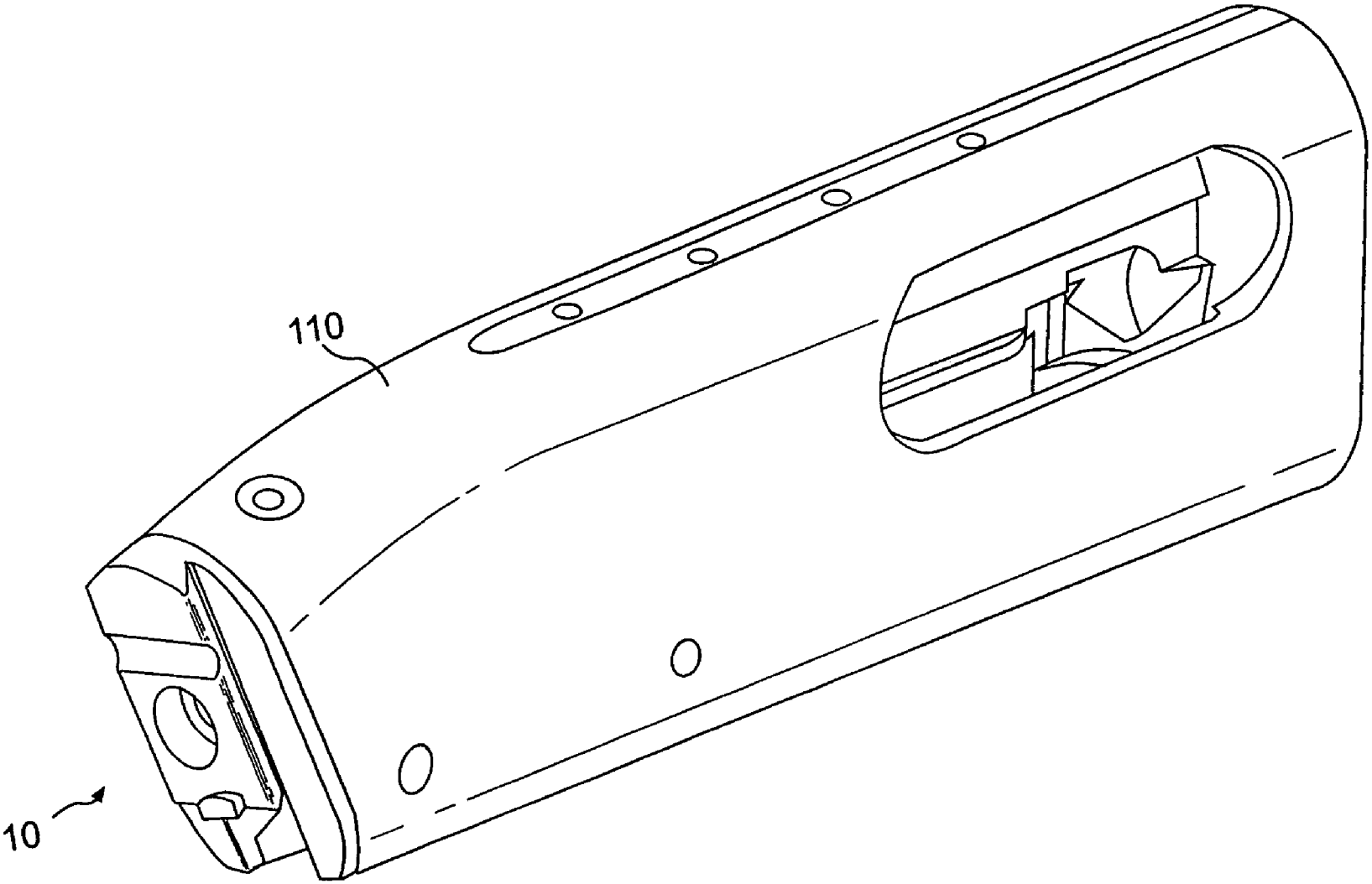
FIG. 6 is a perspective view of an assembly step for assembling a firearm using the stock connector according to the first embodiment.

FIGS. 5–9 illustrate assembly steps for the firearm 100 using the stock connector 5. Referring to FIGS. 5 and 6, the first connector 10 is first mounted within a receiver mounting cavity or recess 112 of the receiver 110, and a fastener 22 is pushed through the bore 16 and threaded into a threaded female fastener 114 that is connected to a rear face of the receiver 110. The female fastener 114 can be, for example, a nut. The fastener 22 is tightened in the female fastener 114 to secure the first connector 110 in the mounting recess 112. FIG. 6 illustrates the first connector 10 fully seated in the receiver 110. When the first connector 10 is seated in the receiver 110, the projecting portion 36 is received within the mounting recess 112, and the face 34 formed by the peripheral relief 32 rests against a rear surface of the receiver 110.

Figure 7:
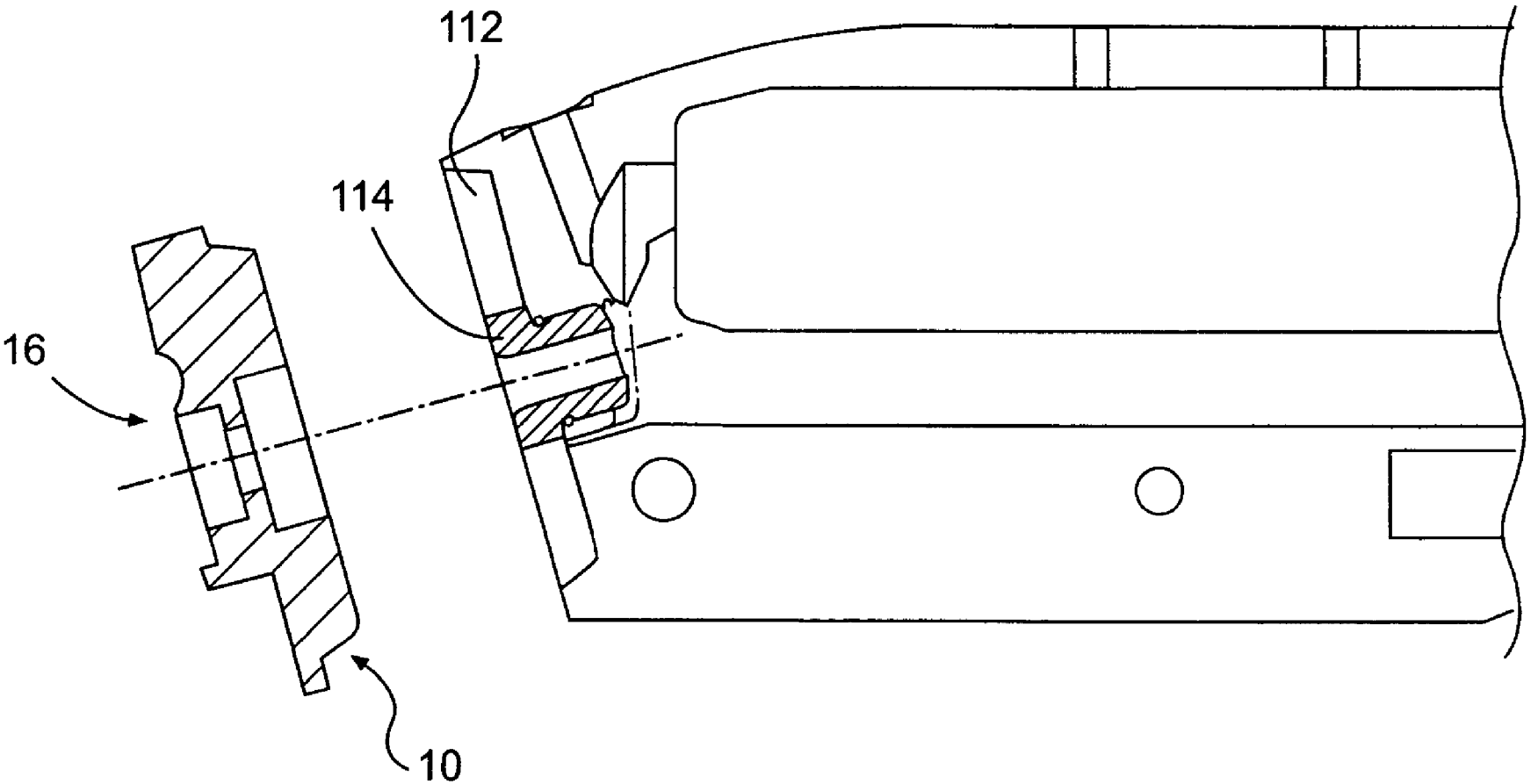
FIG. 7 is a section view of an assembly step for assembling a firearm using the stock connector according to the first embodiment.

FIG. 7 is a section view of the first connector 10 and the receiver 110. As shown in FIG. 7, the female connector 114 can be similar to a stock bolt nut. The female connector 114 can be installed in conventional, unmodified firearms, by replacing the stock bolt nut with the female connector 114, which may be similar to, and typically smaller than, the stock bolt nut. The receiver base is then held in place by the receiver base screw.

Figure 8:
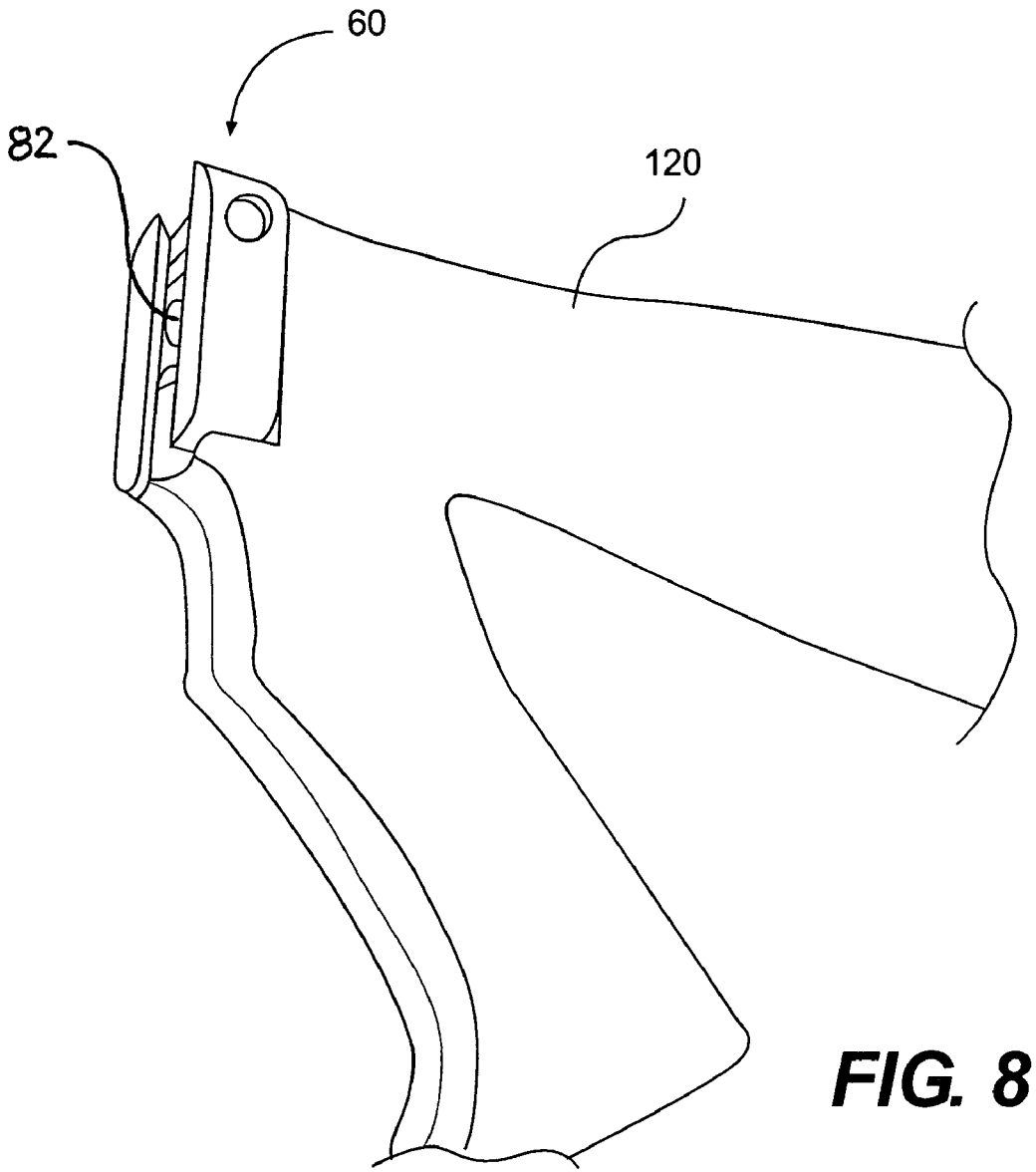
FIG. 8 is a perspective view of an assembly step for assembling a firearm using the stock connector according to the first embodiment.

FIG. 8 illustrates installation of the second connector 60 on the stock 120. The second connector 60 is placed within a stock mounting recess, with the stud 80 (not shown in FIG. 8) extending into the interior of the stock 120. A fastener (not shown) is inserted into the bore 82 and into a threaded female portion (not shown) of the stock 120. In one embodiment, prior to fastening the fastener, adhesive is placed on the portions of the second connector 60 that will contact the stock 120 to ensure secure connection to the stock 120.

Figure 9:
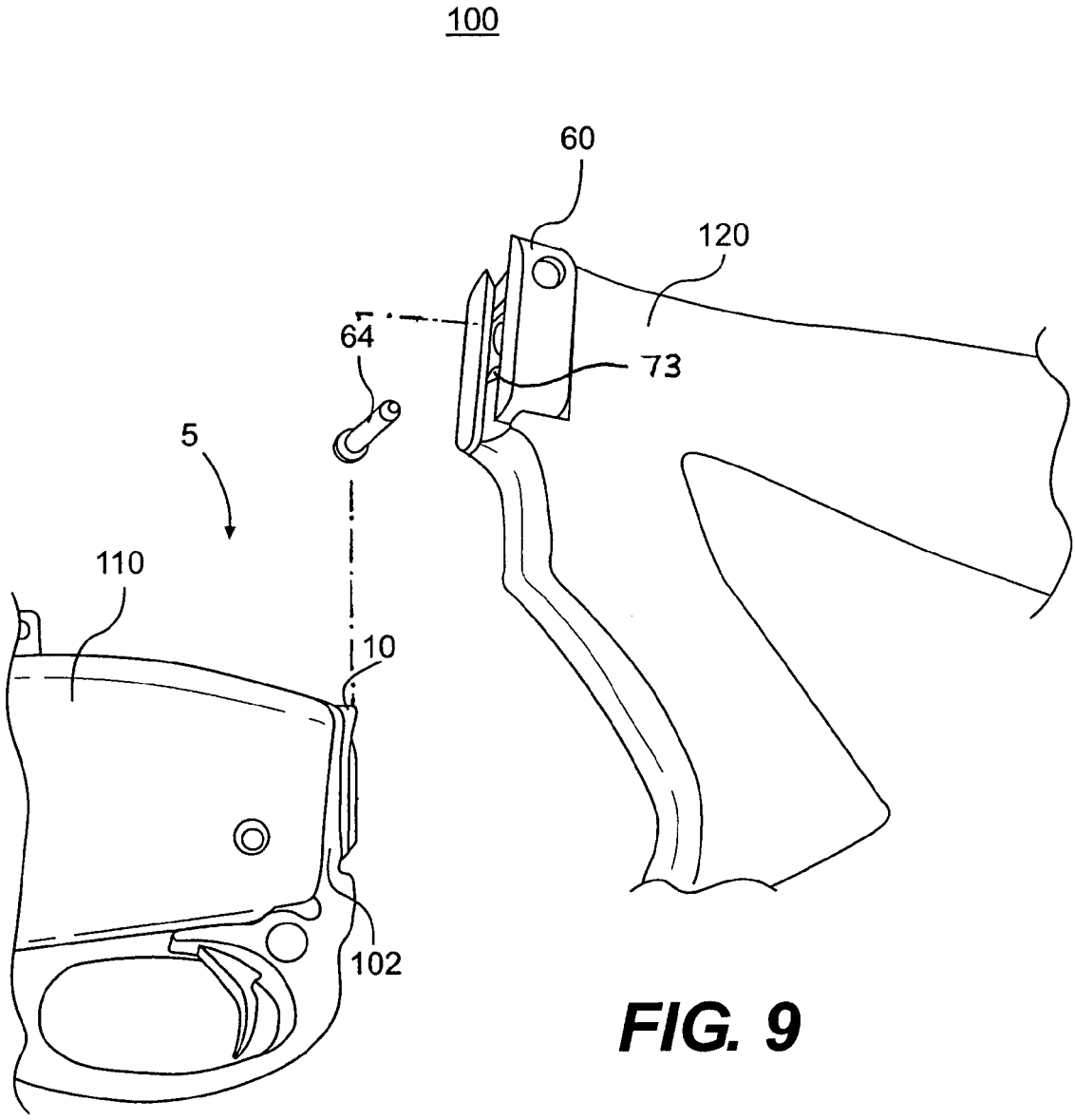
FIG. 9 is a perspective view of an assembly step for assembling a firearm using the stock connector according to the first embodiment.

FIG. 9 is a section view illustrating joining the receiver 110 to the stock 120 by mounting the engagement lug 40 of the first connector 10 within the dovetail recess 72 of the second connector 60. This is done by raising the stock 120, along with the second connector 60, above the receiver 110 and the first connector 10. The dovetail recess 72 is then slid down over the engagement lug 40 until the stop projection 48 (FIG. 3) contacts the top of the stop recess 73 (FIG. 2). The locking member 64 is then inserted into the receiving aperture 74. The locking member 64 engages the recess 46 in the engagement lug 40 and prevents vertical translation of the lug 40 within the dovetail recess 72.

Figure 10:
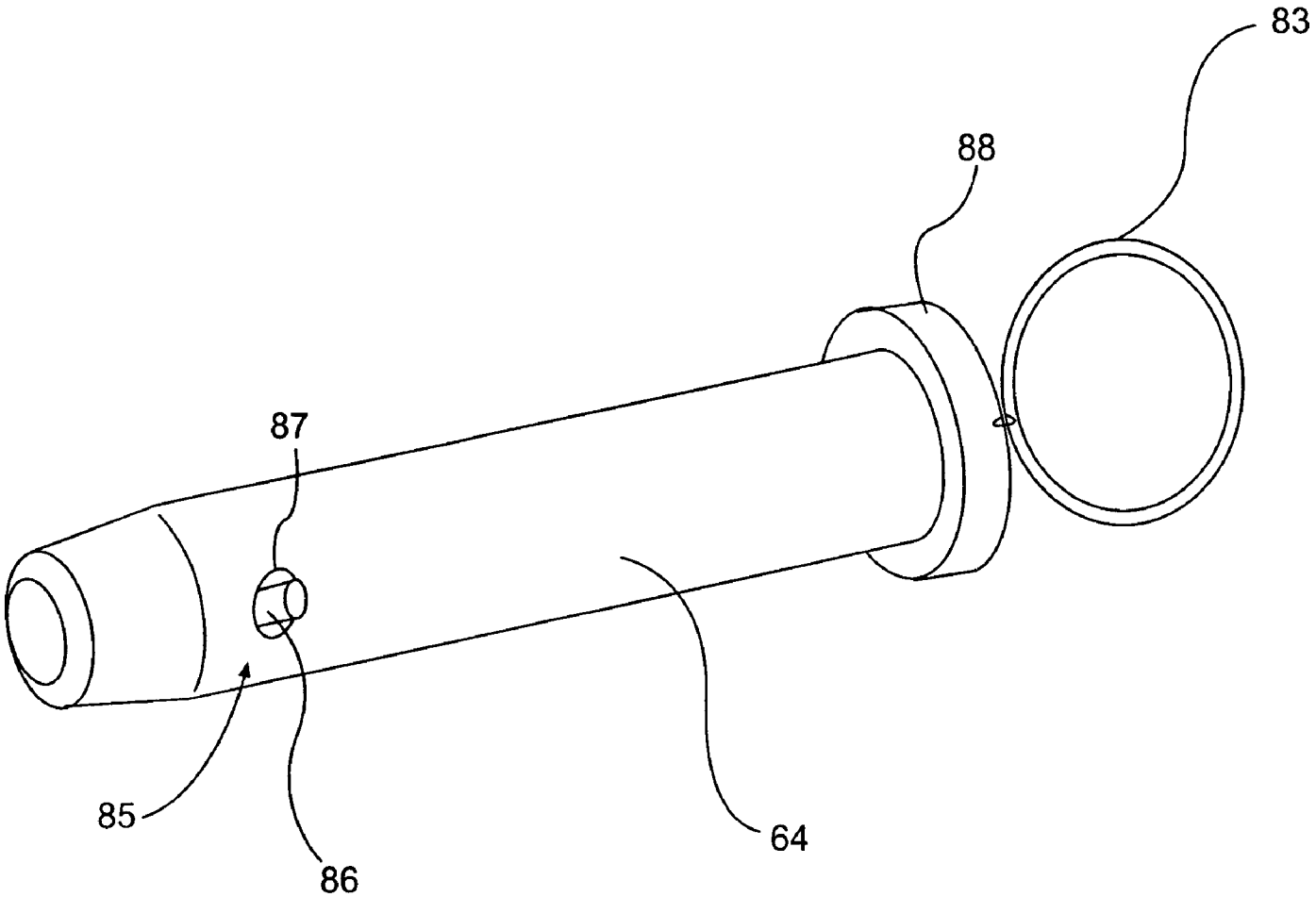
FIG. 10 is a perspective view of a locking member.

FIG. 10 is a detailed view of the locking member 64. The locking member 64 may have the form of a rod or pin, for example. The locking member 64 can have, for example, a pull ring 83 that enables a user to easily disengage the member 64 from the stock connector 5, and thereby quickly disconnect the firearm receiver from the stock. The locking member 64 may also include a retention device 85 at one end. The retention device 85 may include a spring loaded rod or ball 86 that is biased outwardly from an opening 87 in the member 64. Referring also to FIG. 2, the rod or ball 86 may be depressed in order to mount the member 64 in the receiving aperture 74, and once a head 88 abuts the second connector 60, the retention device 85 will be located on the other side of the receiving aperture 74, securing the member 64 within the aperture 74. The retention device 85 may be depressed to remove the locking member 64 from the receiving aperture 74. The ring 83 may be substituted with other graspable elements, such as, for example, a lanyard, chain, or similar device. The retention device 85 may be substituted with other securing mechanisms, such as, for example, a cotter pin extending through a bore in the locking member 64.

Figure 11:
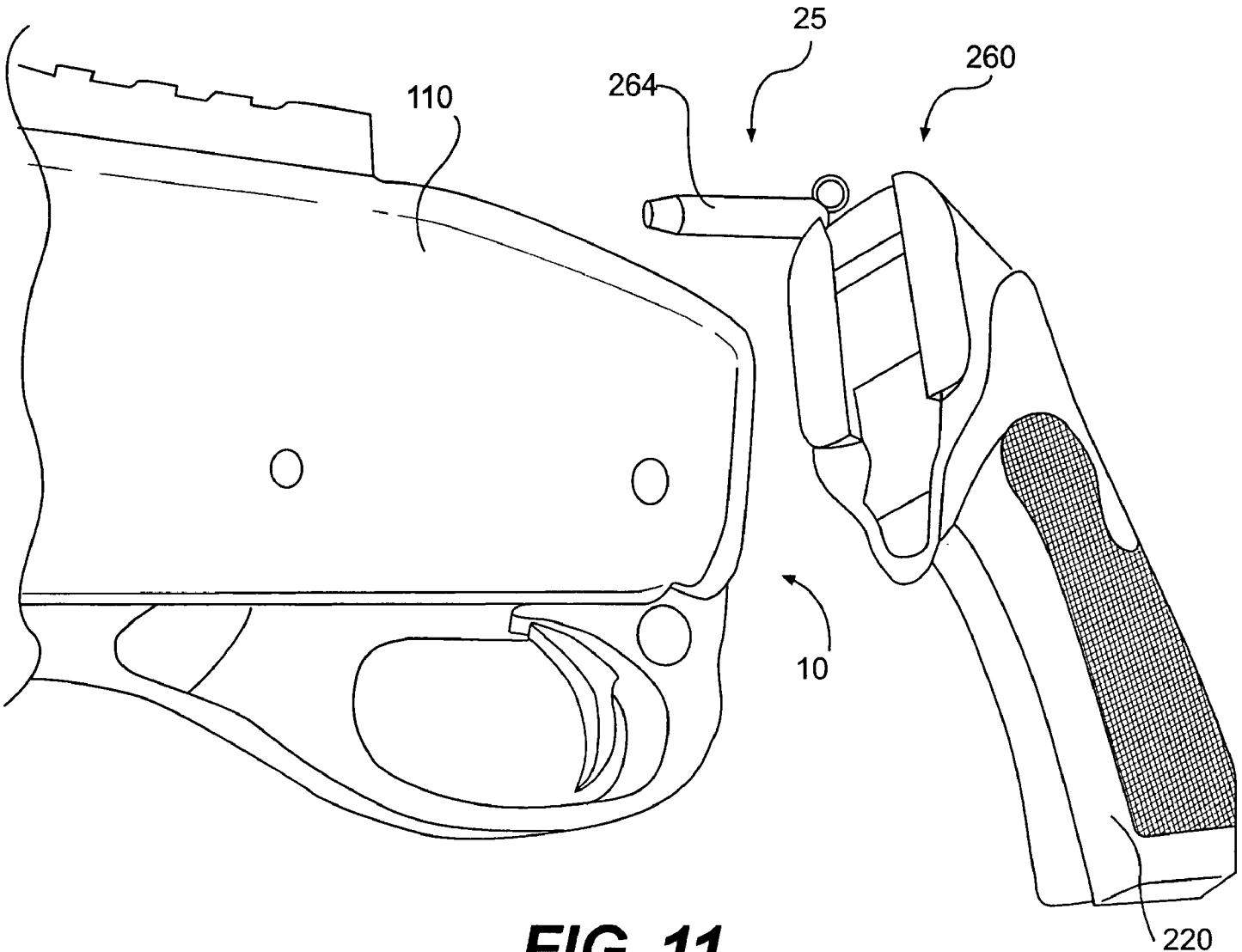
FIG. 11 is a perspective view of a disassembled firearm having a pistol grip stock and a stock connector according to a second embodiment.

FIG. 11 illustrates a pistol grip stock 220 that can be attached to the receiver 110 using an alternative embodiment of a second connector 260. According to one aspect of the invention, the first connector 10 may be suitable to connect to stocks equipped with either of the second connectors 60, 260. The second connector 260 may be attached to the pistol grip stock 220 in a manner similar to the attachment of the second connector 60 to the stock 120, as discussed above. The locking member 64 used to secure the first connector 10 to the second connector 60 may also be suitable for use with the second connector 260.

Figure 12:
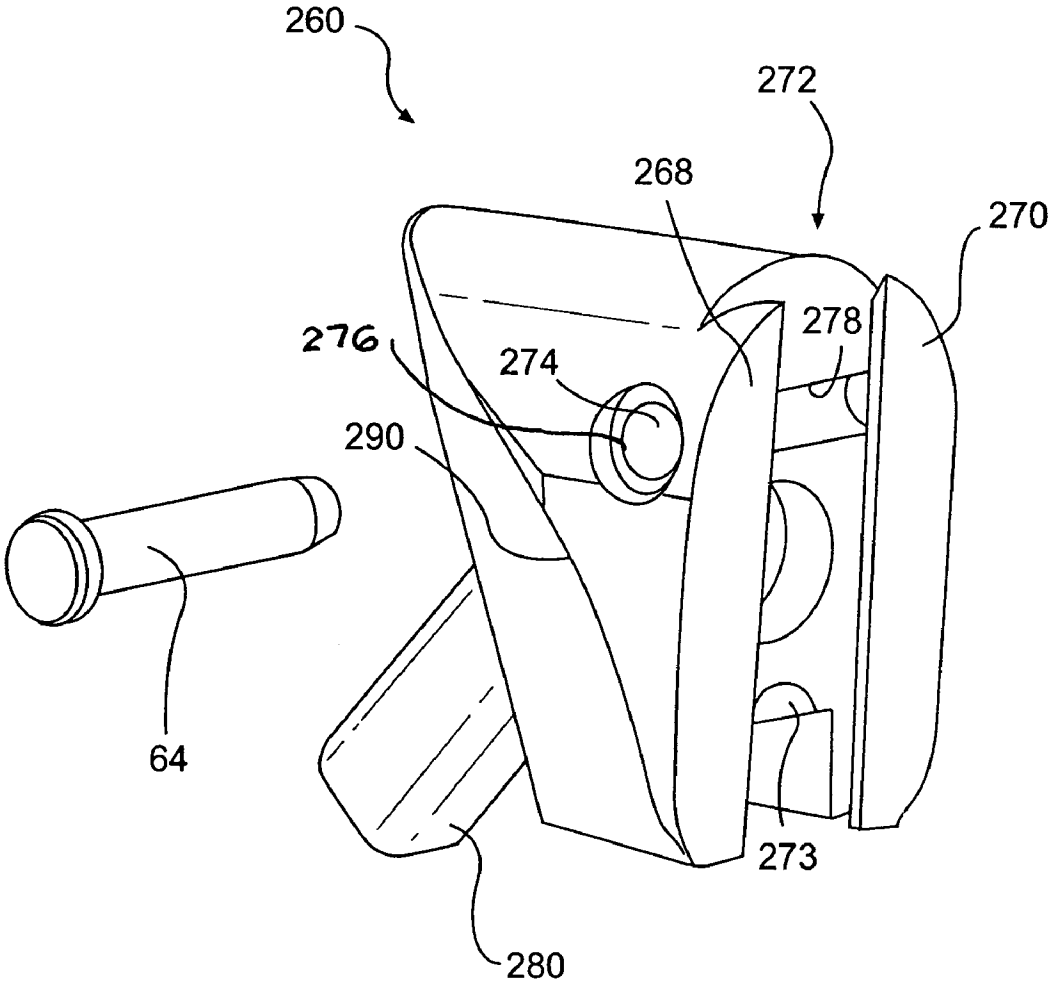
FIG. 12 is a perspective view of a second connector of the stock connector according to the second embodiment.

FIG. 12 is a perspective view of the second connector 260 and the locking member 64. The second connector 260 has arms 268, 270 which form a dovetail locking arrangement with the first connector 10 engagement lug 40. An arched stop recess 273 extends across a bottom portion of a dovetail recess 272 and defines an uppermost point of travel for the engagement lug 40 as it slides within the dovetail recess 272. A transverse receiving aperture or bore 274 extends through the second connector 260 and is adapted to receive the locking member 64.

Figure 13:
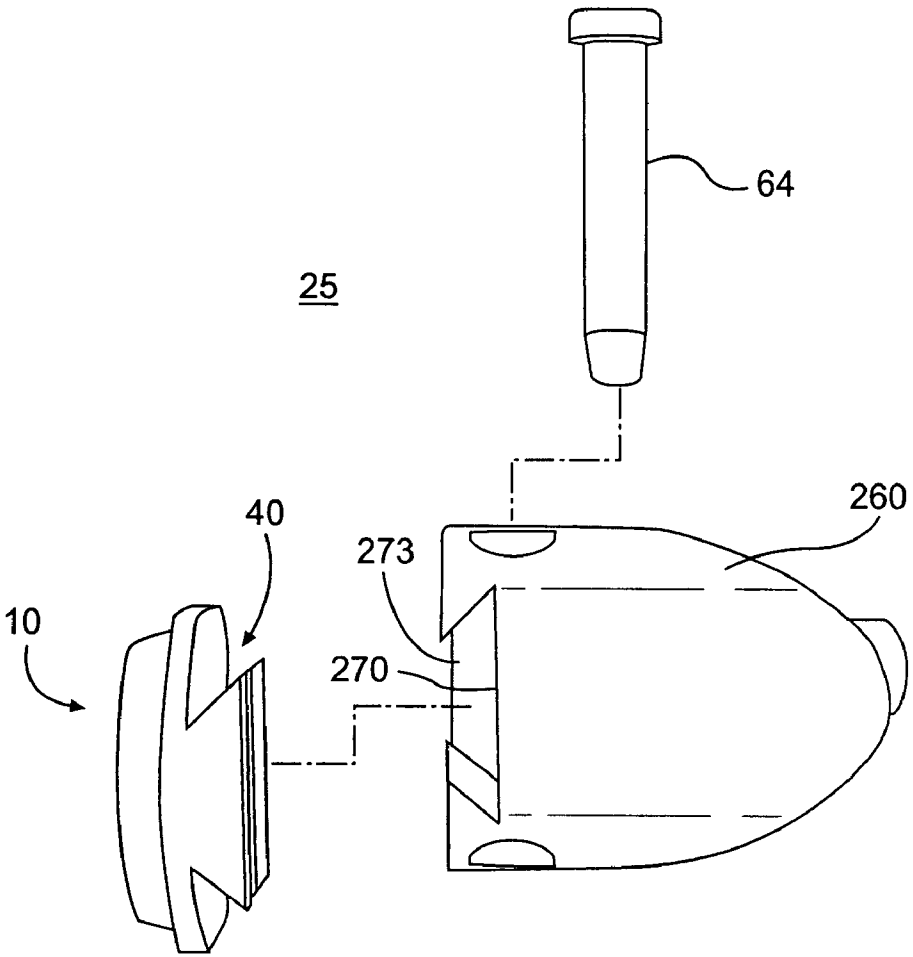
FIG. 13 is an exploded top perspective view of the stock connector according to the second embodiment.
Figure 14:
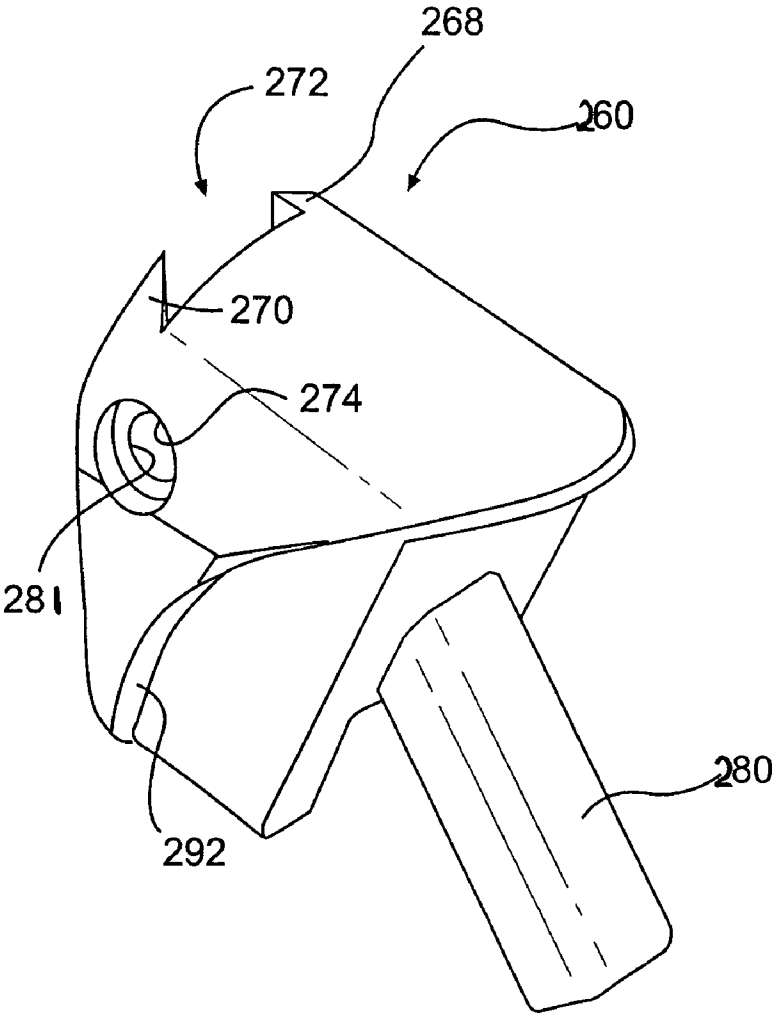
FIG. 14 is a perspective view of the second connector according to the second embodiment.

Referring also to FIGS. 13 and 14, the receiving aperture 274 comprises a first transverse bore 276, a transverse slot or recess 278, and a second transverse bore 281. The bores 276, 281 and the recess 278 can have circular or arcuate cross sections that may generally correspond to the periphery of the locking member 64, and may be formed in a single drilling operation. When the engagement lug 40 is received within the dovetail recess 272 of the second connector 260, and the locking member 64 is received within the receiving aperture 274, the engagement of the locking member 64 with the locking recess 46 prevents removal of the engagement lug 40 from the arms 268, 270. The locking member 64 thereby fixes the position of the first connector 10 relative to the second connector 260.

The receiving aperture 274 is described herein as 'transverse' to indicate that the bores 276, 281 and the slot or recess 78 extend generally perpendicular or transverse to a long axis of the firearm 100. The term 'transverse' does not require strict perpendicularity with the long axis of the firearm, however.

FIGS. 12 and 14 illustrate that the second connector 260 is sloped generally along the contours 290, 292, which may be adapted to mate with the contour of the stock 220. The contour of the second connector 260 thus can be formed with a variety of different configurations or designs as desired to match a particular stock, such as, for example, various pistol grip stocks, folding stocks, and full length stocks.

The second connector 260 may also include a projecting rod or post 280 that extends into and engages the stock 220. The rod 280 stabilizes the second connector 260 within the stock 220. The rod 280 can include a bore or aperture adapted to receive a fastener such as a screw or bolt therein to secure the second connector 260 to the stock 220. The rod 280 can be machined integrally with the second connector 260, or it may be a removable piece attached to the connector 260 by a threaded arrangement or other attachment mechanisms. The second connector 260 can also be attached to the stock 220 by a variety of fasteners or other mechanisms, such as, for example, a weld, adhesives such as epoxies or other, similar adhesive materials.

Figure 15:
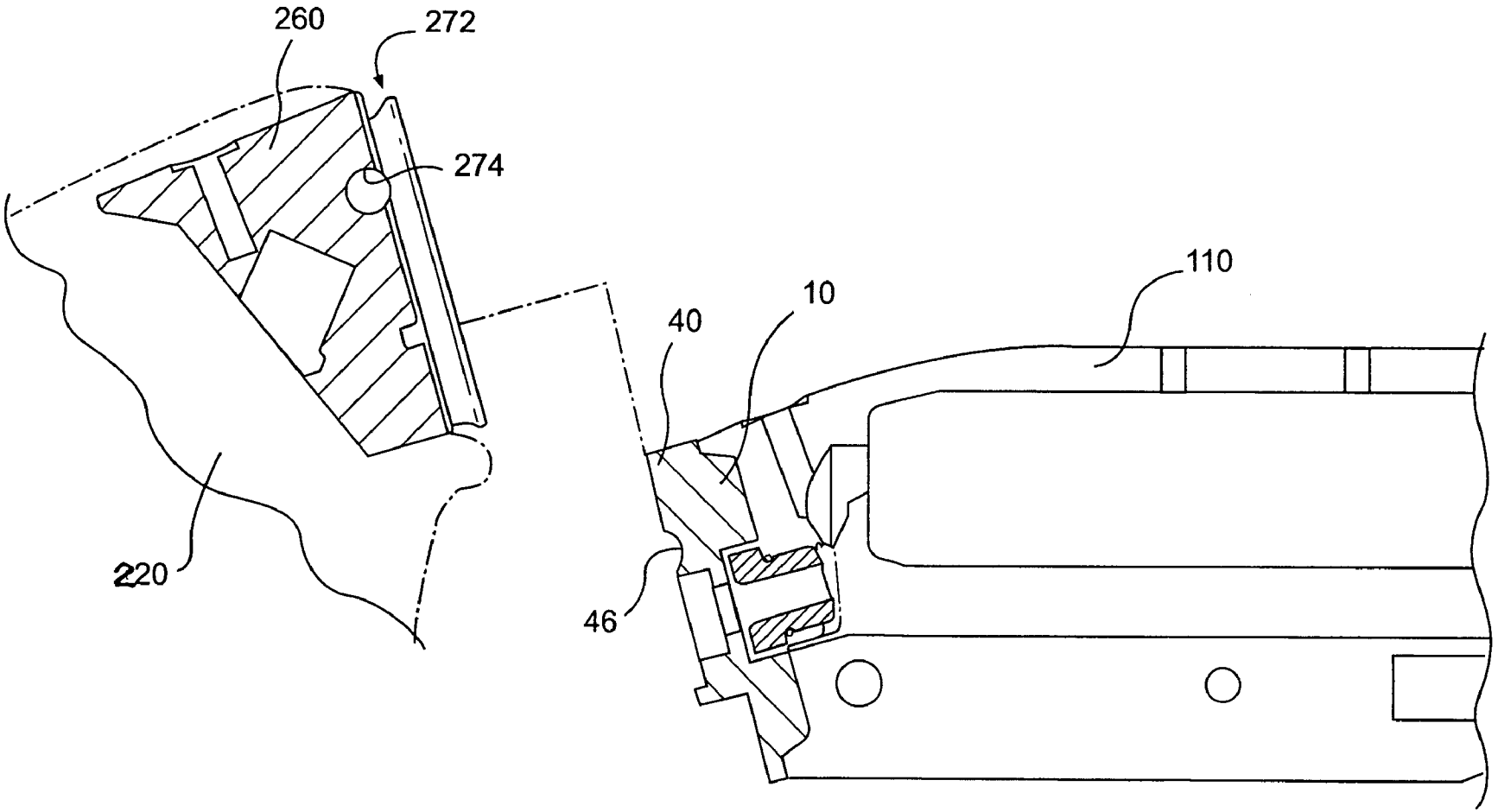
FIG. 15 is a section view of an assembly step for assembling a firearm using the stock connector according to the second embodiment.

FIG. 15 is a section view illustrating joining the receiver 110 to the stock 220 by mounting the engagement lug 40 of the first connector 10 within the dovetail recess 272 of the second connector 260. This is done by raising the stock 220, along with the second connector 260, above the receiver 110 and the first connector 10. The dovetail recess 272 is then slid down over the engagement lug 40 until the stop projection 48 (FIG. 3) contacts the top of the stop recess 273 (FIG. 12). The locking member 64 is then inserted into the receiving aperture 274. The locking member 64 engages the recess 46 in the engagement lug 40 and prevents vertical translation of the lug 40 within the dovetail recess 272.

FIG. 15 illustrates an embodiment of the second connector 260 in which the rod 280 is not formed integrally with the remainder of the second connector 260. The rod 280 may be attached to the second connector 260 prior to installation in the stock, or, the second connector 260 can be attached to the stock by other mechanisms, such as, for example, a fastener extending from the top, bottom or sides of the receiver and extending into the second connector 260. If alternative methods of securement such as welds are used, additional fasteners or adhesives may be unnecessary.

For disassembly, the locking member 64 can be quickly and easily unlocked and thereafter withdrawn from the receiving aperture 274 of the second connector 260. Thereafter, the stock 220 can be slid out of engagement with the receiver 110 for cleaning, maintenance, change out with alternative stocks, or for other purposes.

Figure 16:
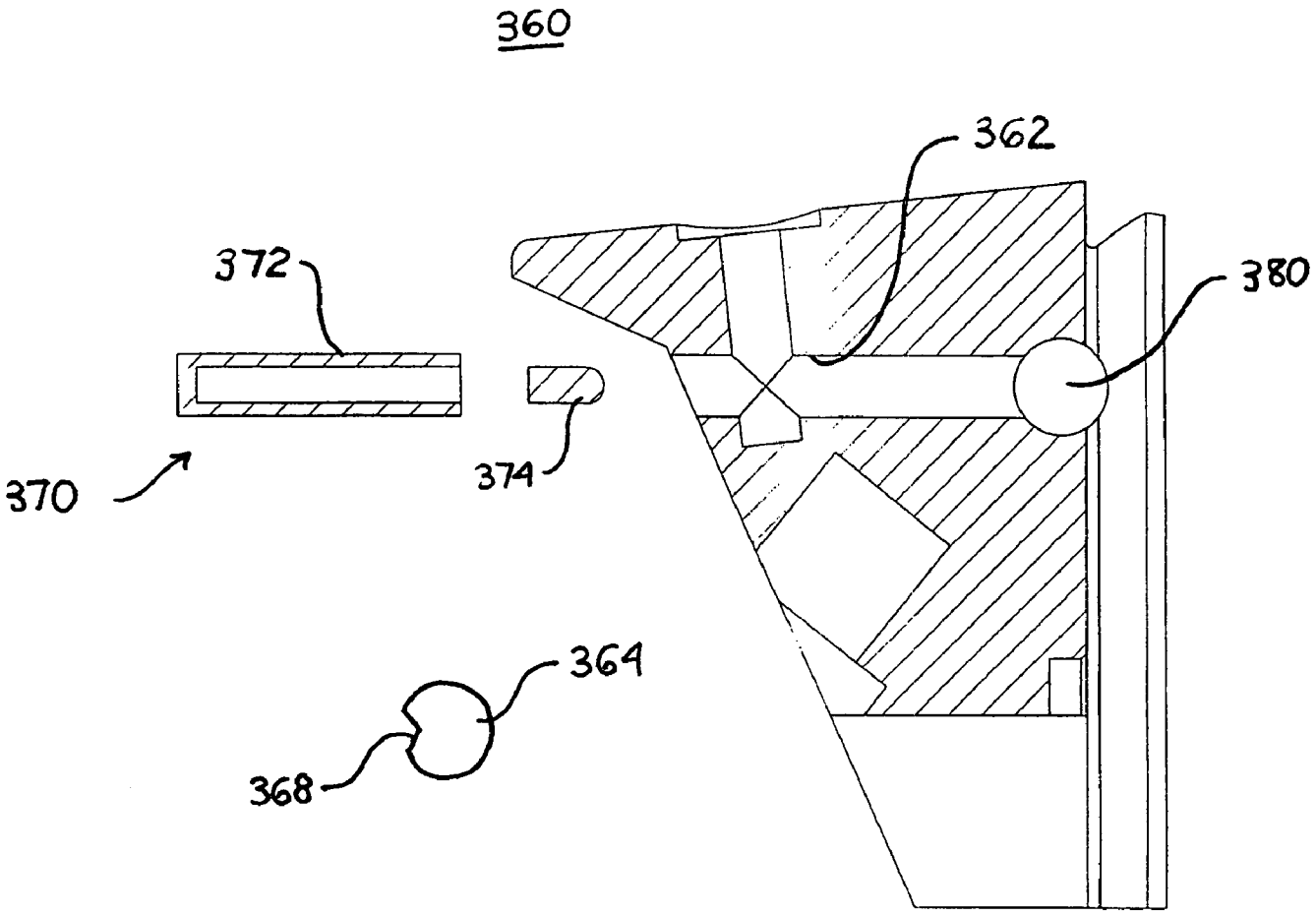
FIG. 16 illustrates an alternative embodiment of a second connector including a retention device.

FIG. 16 illustrates an alternative embodiment of a second connector 360 including a retention device 370 mounted within the second connector 360. The second connector 360 includes a receiving aperture 380, and may be of the same general shape and configuration as the second connector 260 illustrated in FIG. 12. The second connector 360, however, includes the retention device 370, and a separate retention device is not required in the locking member. The retention device 370 includes a hollow cylindrical housing 372 mounted in a bore 362, and a plunger 374 mounted within the housing 372.

The plunger 374 may be biased, such as by a spring (not shown), within the housing 372. When the housing 372, the spring, and the plunger 374 are disposed within the bore 362, the end of the plunger 374 extends a short distance into the receiving aperture 380. The housing 372 can include exterior threads that mate with interior threads on the bore 362, so that the housing 372 can be inserted any desired distance into the bore 362. A locking member 364 (shown in section in FIG. 16), can have the same general configuration of the locking member 64 discussed above, without the retention device. The locking member 364 also has a recess 368, which may be conical, formed on its periphery. The recess 368 is sized to engage with the tip of the plunger 374. The spring loaded plunger 374 engages the recess 368 to hold the locking member 364 in the receiving aperture 380 when it is inserted therein. The bias of the spring is sufficiently light so that a person can remove the locking member 364 from the receiving aperture 380 by pressing firmly on the end of the locking member 364.

Figure 17:
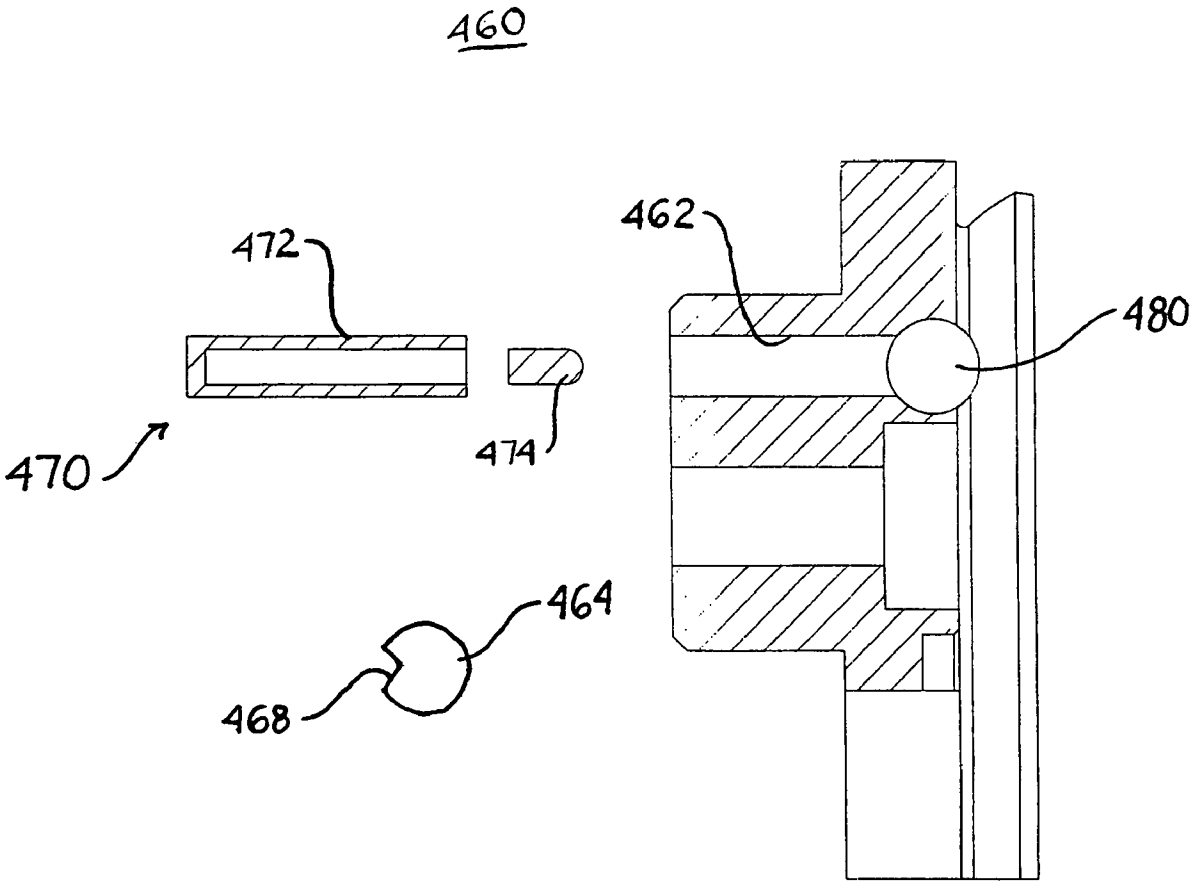
FIG. 17 illustrates an yet alternative embodiment of a second connector including a retention device.

FIG. 17 illustrates yet another alternative embodiment of a second connector 460 including a retention device 470 mounted within the second connector 460. The second connector 460 includes a receiving aperture 480, and may be of the same general shape and configuration as the second connector 260 illustrated in FIG. 2. The retention device 470 includes a hollow cylindrical housing 472 mounted in a bore 462, and a plunger 474 mounted within the housing 472. The plunger 474 may be biased, such as by a spring (not shown), within the housing 472. When the housing 472, the spring, and the plunger 474 are disposed within the bore 462, the end of the plunger 474 extends a short distance into the receiving aperture 480. A locking member 464 (shown in section in FIG. 17), can have the same general configuration of the locking member 64 discussed above, without the retention device. The locking member 464 also has a recess 468, which may be conical, formed on its periphery. The recess 468 is sized to engage with the tip of the plunger 474. The spring loaded plunger 474 engages the recess 468 to hold the locking member 464 in the receiving aperture 480 when it is inserted therein. The bias of the spring is sufficiently light so that a person can remove the locking member 464 from the receiving aperture 480 by pressing firmly on the end of the locking member 464.

The alternative second connectors 360, 460 are engageable with the first connector 10 as discussed above, and operate according to the same principles as the second connector embodiments discussed above.

According to the above embodiments, the stock connector 5 can be used for quickly and securely connecting various types, designs, or configurations of stocks for firearms, including pistol grips, folding stocks, conventional standard full length shoulder stocks, and other stock assemblies.

The stock connector 5 enables a user to quickly and easily mate various stocks with a receiver without requiring the use of tools. Further, additional or external fasteners are not required to change out of the stock. The stock connector 5 thus provides greater versatility and ability to change out the firearm stock, including while in the field. Field versatility is especially applicable to combat situations, such as where a short breaching shotgun or other firearm must be quickly and securely reconfigured to a more conventional type of combat firearm in the face of rapidly changing mission requirements. For example, a pistol grip stock, such as the stock 220 shown in FIG. 11, could be used on a shotgun for close quarter battle situations were greater speed and mobility is required, after which the shotgun or other firearm could be quickly reconfigured with a standard full-length stock, such as the stock 120 shown in FIG. 1, for firing rifled slugs or similar ammunition where greater precision and control at distance is required.

The stock connector 5 therefore provides a gun owner the ability to adapt a single receiver to a multitude of uses. For example, a kit comprising a first connector 10 and one or more second connectors 60, 260 can be assembled to accommodate such uses. The kit may also include one or more stocks suitable for various missions or environments. For example, a kit may include a first connector 10, a shoulder stock 120, a pistol grip stock 220, a locking member 64, and one or more of the second connectors 60, 260, 360, 460. The kit may be adapted to mate with various type of firearm receivers. Folding stocks and other stocks can also be included with corresponding connectors.

The first connector 10 may be formed from rigid materials such as, for example, steel, aluminum and other metals, or other high strength materials including synthetic or plastic materials. The second connector 60, 260 and locking member 64 can be formed from similar materials.

The female connector 114 can be installed in conventional, unmodified firearms, by replacing the stock bolt nut with the female connector 114, which may be similar to, and typically smaller than, the stock bolt nut. For example, the REMINGTON™ 870 model shotgun can accommodate the stock connector 5 without modification. The connector embodiments discussed above may be adapted by, for example, changing the contour of the connectors, to mate with other firearm models.

The locking members 64, 364, 464 can be any rod-like elongate element, and need not have a circular or arcuate cross section. A flattened side can be included on the locking members 364, 464, along with a flattened portion of their respective receiving apertures 380, 480, to ensure that the recesses 368, 468 align with their respective bores 362, 462.

In the above embodiments, the slidable dovetail engagement is oriented along the vertical axis of the firearm. In alternative embodiments, the dovetail engagement can be oriented transverse or substantially transverse to the vertical axis of the firearm. In this embodiment, the receiver would be placed beside the stock, rather than below, and slid into engagement with the stock. In this embodiment, a locking member may be engaged with the first and second connectors by downward insertion from above the firearm.

The embodiment discussed above is described as useful in shotguns, rifles, and other long guns. Those of ordinary skill in the art will recognize that the present invention further can be adapted for use in various other types of firearms as well.

In the above embodiments, the dovetail recess is associated with the second connector, which is connected to the stock, and the engagement lug is associated with the first connector, which is connected to the receiver. The dovetail recess could, however, alternatively be part of the first connector, and the engagement lug could be part of the second connector.

The above embodiments disclose dovetail connections between the receiver and stock. An alternative embodiment includes a mortise/tenon engagement. The connector associated with either the stock or receiver can be equipped with a tenon, and the other connector can include a mortise. The mortise and tenon on the connectors can be slidably engaged in the same way as the dovetail joints described above. A locking member, which may be transversely engageable with the mortise/tenon connection, can ensure that the connectors are secured. In one such embodiment, a stock connector assembly for a firearm comprises a connector having an engagement lug with at least one mortise formed therein, and a second connector having at least one tenon formed therein, wherein the tenon of the second connector is adapted to engage the mortise of the first connector.

In still yet another embodiment, one connector may have a projecting lug that is rotatably engaged with a receiving aperture on the other connector.

It will be understood by those skilled in the art that while the present invention has been discussed above with reference to preferred embodiments, various additions, modifications, and variations can be made thereto without departing from the spirit and scope of the present invention.

What is claimed:

1. A firearm, comprising:

a barrel;

a receiver operably connected to said barrel;

a stock;

a first connector connected to one of said receiver and said stock;

a second connector connected to the other one of said receiver and said stock; and a locking member extending generally transverse to a long axis of said firearm, wherein said first and second connectors connect said receiver to said stock by a dovetail locking arrangement, and said locking member secures said first connector relative to said second connector, said first connector comprises an engagement lug having a generally transverse recess, said engagement lug forming a part of said dovetail locking arrangement, said second connector comprises a dovetail recess adapted to receive said engagement lug and forming part of said dovetail locking arrangement, and a generally transverse receiving aperture extending through said second connector, wherein said locking member is adapted to be received in said receiving aperture, and said firearm is in an assembled state when said engagement lug is disposed within said dovetail recess and said locking member is received in said receiving aperture and abuts said generally transverse recess of said engagement lug.

2. The firearm of claim 1, wherein said first connector further comprises a fastener connected to said receiver and extending through a bore in said first connector.

3. The firearm of claim 1, wherein said first connector comprises a stop projection extending from said engagement lug.

4. The firearm of claim 3, wherein said second connector comprises a stop recess that is adjacent to said stop projection when said first and second connectors are connected.

5. The firearm claim 1, wherein said stock comprises one of a pistol grip, a rifle butt, and a folding stock.

6. A firearm, comprising:

a barrel;

a receiver operably connected to said barrel;

a stock;

a first connector connected to one of said receiver and said stock;

a second connector connected to the other one of said receiver and said stock and comprising generally transverse receiving aperture extending through said second connector, said receiving aperture comprising:

a first generally transverse bore extending through a first side of said second connector;

a second generally transverse bore extending through a second side of said second connector; and a central recess extending between said first and second bores; and a locking member extending generally transverse to a long axis of said firearm, wherein said locking member is adapted to be received in said receiving aperture, and wherein said first and second connectors connect said receiver to said stock by a dovetail locking arrangement, and said locking member secures said first connector relative to said second connector.

7. The firearm of claim 6, wherein said locking member extends through said dovetail locking arrangement.

8. The firearm of claim 7, wherein said first connector is slidably engageable with said second connector along a first direction, and said locking member extends along a second direction substantially perpendicular to said first direction when securing said first and second connector.

9. A stock connector for connecting a receiver of a firearm to a firearm stock, comprising:

a first connector adapted to be connected to one of said stock or receiver, the first connector having an engagement lug, said engagement lug having a recess;

a second connector adapted to be connected to one of said stock or receiver, the second connector having a dovetail recess adapted to receive said engagement lug, and a generally transverse receiving aperture extending through said second connector; and a locking member adapted to be received in said receiving aperture and to enter said recess in said first connector when said engagement lug is mounted in said dovetail recess.

10. The stock connector of claim 9, wherein said receiving aperture faces said recess in said engagement lug when said engagement lug is mounted in said dovetail recess.

11. The stock connector of claim 10, wherein said receiving aperture is continuous with said dovetail recess.

12. The stock connector of claim 10, wherein said recess in said engagement lug extends substantially parallel to said receiving aperture in said second connector when said engagement lug is received in said dovetail recess.

13. The stock connector of claim 12, wherein said first connector comprises a stop projection extending from said engagement lug.

14. The stock connector of claim 13, wherein said second connector comprises a stop recess in said dovetail recess, said stop recess being adjacent to said stop projection when said engagement lug is mounted in said dovetail recess.

15. The stock connector of claim 10, wherein said first connector is slidably engageable with said second connector along a first direction, and said locking member extends along a second direction substantially perpendicular to said first direction when securing said first and second connector.

16. A stock connector for connecting a receiver of a firearm to a firearm stock, comprising:

a first connector, comprising:

means for connecting said first connector to one of said stock or receiver; and an engagement lug having a recess;

a second connector, comprising:

means for connecting said second connector to one of said stock or receiver;

a dovetail recess adapted to slidably receive said engagement lug; and a generally transverse receiving aperture extending through said second connector, the receiving aperture being continuous with said dovetail recess; and a locking member adapted to be received in said receiving aperture and to enter said recess in said first connector when said engagement lug is mounted in said dovetail recess, wherein said recess in said engagement lug extends substantially parallel to said receiving aperture in said second connector when said engagement lug is mounted in said dovetail recess.

17. The stock connector of claim 16, wherein said first connector comprises a stop projection extending from said engagement lug.

18. The stock connector of claim 17, wherein said second connector comprises a stop recess in said dovetail recess, wherein said stop projection engages said stop recess when said engagement lug is mounted in said dovetail recess.

19. The stock connector of claim 16, wherein said first connector is slidably engageable with said second connector along a first direction, and said locking member extends along a second direction substantially perpendicular to said first direction when securing said first and second connector.

20. A stock connector for connecting a receiver of a firearm to a firearm stock, comprising:

a first connector adapted to be connected to a first part of a firearm, said first connector comprising a recess;

a second connector adapted to be connected to a second part of a firearm, wherein said second connector comprises a generally transverse receiving aperture extending through said second connector and is engageable with said first connector, and a dovetail recess adapted to receive a portion of said first connector, wherein said receiving aperture is continuous with said dovetail recess; and a locking member adapted to be received in said receiving aperture and to secure said first connector to said second connector when said first and second connectors are engaged, wherein said locking member is adapted to enter said recess in said first connector when said portion of said first connector is received in said dovetail recess in said second connector, said locking member's presence in said recess positioning said first connector relative to said second connector.

21. The stock connector of claim 20, wherein said first connector is slidably engageable with said second connector along a first direction, and said locking member extends along a second direction substantially perpendicular to said first direction when securing said first and second connector.

22. The stock connector of claim 21, wherein said first connector comprises:

a front side;

a rear side;

a bore extending from said front to said rear side;

a fastener adapted to be received in said bore; and a peripheral relief extending around a perimeter of said front side.

23. The stock connector of claim 21, wherein said first connector further comprises a stop projection.

24. The stock connector or claim 21, wherein said receiving aperture faces said recess in said first connector when said portion of said first connector is received in said dovetail recess in said second connector.

* * * * *